US005194173A

United States Patent [19]

Folkard et al.

[11] Patent Number: 5,194,173

[45] Date of Patent: Mar. 16, 1993

[54] METHOD OF RECOVERING OILY CONTAMINANTS FROM PRINTING MACHINES, PLATES AND RELATED EQUIPMENT

[75] Inventors: Christopher W. Folkard; Gary A. J. Goddard, both of Leeds, United Kingdom

[73] Assignee: DuPont (UK) Ltd., Leeds, United Kingdom

[21] Appl. No.: 824,801

[22] Filed: Jan. 22, 1992

[30] Foreign Application Priority Data

Jan. 29, 1991 [GB] United Kingdom ..... 9101850

[51] Int. Cl.[5] ..... B08B 3/08; C11D 7/26; C11D 7/50; C23G 5/032

[52] U.S. Cl. ..... 252/170; 134/40; 134/42; 252/136; 252/143; 252/162; 252/171; 252/173; 252/174.21; 252/174.22; 252/550; 252/557; 101/424

[58] Field of Search ..... 101/424; 134/40, 42; 252/162, 170, 171, 173, DIG. 14

[56] References Cited

U.S. PATENT DOCUMENTS

| | | | |
|---|---|---|---|
| 4,180,472 | 12/1979 | Mitchell | 252/162 |
| 4,295,845 | 10/1981 | Sepulveda | 252/162 |
| 4,673,526 | 6/1987 | Zabotto | 252/174.16 |
| 4,707,293 | 11/1987 | Ferro | 252/174.17 |
| 4,806,262 | 2/1989 | Snyder | 252/90 |
| 4,877,556 | 10/1931 | Wilsberg | 252/544 |
| 4,986,927 | 1/1991 | Elton | 252/118 |
| 4,997,588 | 3/1991 | Gillich | 252/139 |
| 5,015,471 | 5/1991 | Birtwistle | 424/70 |
| 5,089,269 | 2/1992 | Noda | 424/456 |
| 5,104,567 | 4/1992 | Staehr | 252/174.17 |

FOREIGN PATENT DOCUMENTS

90/3419 4/1990 PCT Int'l Appl. .

*Primary Examiner*—Dennis Albrecht

*Attorney, Agent, or Firm*—Wood, Phillips, VanSanten, Hoffman & Ertel

[57] ABSTRACT

A method of removing inks and other oily contaminants from printing machines, printing plates and offset blankets using a cleaning aid that is based on a $C_6$ or higher alkyl ester of a fatty acid, preferably containing 8 to 22 carbon atoms. The cleaning aid does not significantly degrade images on printing plates.

8 Claims, No Drawings

METHOD OF RECOVERING OILY CONTAMINANTS FROM PRINTING MACHINES, PLATES AND RELATED EQUIPMENT

This invention relates to printing and is concerned with removing oily contaminants from printing machines, printing plates and the like.

During printing, it is known for fat, ink and other oily contaminants to accumulate on, for example, the rollers of the printing machine and, in the case of lithographic printing, on the offset blanket. Such contaminants need to be removed in order to maintain printing quality. Also, such contaminants would need to be removed if the printing machine were to be shut down for any length of time (e.g. overnight) or at the end of a print run when the printing machine is being prepared for the next printing operation. Various cleaning aids have been used for this purpose. For example, organic solvents such as white spirit and the like have been used. However such materials are environmentally unsatisfactory.

International Patent Publication No. WO 90/03419 describes the use of $C_1$ to $C_5$ alkyl esters of aliphatic $C_8$–$C_{22}$ monocarboxylic acids, either singly or in combination with other compounds, as cleaning aids for the removal of fat, inks and the like from printing presses, especially offset printing presses. The aliphatic acid may be a single component or a blend, and may be derived from naturally occurring vegetable oils. Fatty acids derived from vegetable oils are typically $C_8$–$C_{22}$ monocarboxylic acids which may be either saturated or unsaturated, and which may, in some instances, contain hydroxyl groups. In accordance with WO 90/03419, the most suitable esters are methyl, ethyl and isopropyl esters, or mixtures thereof.

In many cases, during normal usage of such cleaning aids, it is common for the cleaning aid to come into contact with the printing plate Cleaning aids based on $C_1$ to $C_5$ alkyl esters of fatty acids have been observed to cause attack of the printing image of the plate, resulting in a loss of print quality, or even, in some instances, complete failure of the printing process. Surprisingly, it has been found that cleaning aids based on higher alkyl esters of fatty acids give a dramatic reduction in the severity of attack on the printing image without loss of cleaning power. Thus, contact of the printing plate with such a cleaning aid which is likely to occur during press-cleaning is very unlikely to cause any reduction in print quality or press-life.

According to a first aspect of the present invention there is provided a method of removing oily contaminants formed on surfaces of printing machines, printing plates and associated equipment which comprises the step of treating the surface with a cleaning aid comprising at least one $C_6$ or higher alkyl ester of a fatty acid.

The alkyl esters used in accordance with the invention are biologically degradable, non-toxic and have low vapour pressures and high flash points. They give exceptionally low swelling of rubber or synthetic rubber rollers and offset blankets and they may safely be used for cleaning all types of printing image, and especially the images on lithographic printing plates.

Thus, the cleaning aid may be used for removing fats and inks from printing machines, or for cleaning or washing out printing plates and printing images.

The fatty acid may be a saturated or unsaturated aliphatic monocarboxylic acid which preferably has from 8 to 22 carbon atoms. A mixture of such esters may be used and the preferred ester is the 2-ethyl hexyl ester of mixed fatty acids derived from coconut oil.

The ester is the essential ingredient of the cleaning aid and may constitute the sole component of the cleaning aid. However, in such a case difficulties may be encountered in handling the cleaning aid because of its high viscosity and lack of water solubility.

The viscosity of the cleaning aid can be reduced by the incorporation of a vegetable oil (in an amount up to, for example 10% by volume) and/or an organic solvent (in an amount of up to 30% by volume, for example). The inclusion of organic solvent can also increase the solvent power of the cleaning aid, when necessary. Examples of suitable organic solvents are petroleum distillates, hydrocarbons (aliphatic, aromatic or alicyclic), terpenes, halogenated solvents, alcohols, glycol ethers, esters, and ketones. The solvent power of the cleaning aid may also be increased, if necessary, by the incorporation of up to, for example, 10% by volume of $C_1$ to $C_5$ alkyl esters of fatty acids.

The cleaning aid may be made more soluble/miscible in water by the incorporation of a surfactant or emulsifier in an amount of up to, for example, 20% by volume. Anionic and non-ionic surfactants are preferred.

Other components may be included in the cleaning aid to impart particular characteristics. These other components may be selected from, for example, up to about 60% by volume of water to form an emulsion, up to about 20% by volume of an acid, base or alkali, up to about 20% by volume of a buffer system, up to about 10% by volume of a sequestrant, and up to about 10% by volume of a corrosion inhibitor.

These other components, and their amounts, are selected to ensure that the beneficial properties imparted by the use of the $C_6$ or higher fatty acid ester are not compromised.

Generally, in the case where other components are present, the cleaning aid should include at least 30% by volume of the $C_6$ or higher fatty acid ester.

Accordingly, a second aspect of the present invention provides a cleaning aid for removing oily contaminants formed on the surface of printing machines, printing plates, and associated equipment, which cleaning aid comprises a $C_6$ or higher alkyl ester of a fatty acid in an amount of at least 30% by volume, a surfactant in an amount of up to 20% by volume and/or an organic solvent in an amount of up to 30% by volume, the cleaning aid optionally including up to 10% by volume of a vegetable oil, up to 10% by volume of a $C_1$ to $C_5$ alkyl ester of a fatty acid, and up to 60% by volume of water.

In accordance with this aspect of the invention the cleaning aid includes, in addition to the $C_6$ or higher alkyl ester of the fatty acid, surfactant and/or organic solvent. Optionally, the cleaning aid also includes vegetable oil and/or the $C_1$ to $C_5$ alkyl ester of the fatty acid and/or water.

The following Examples illustrate the invention and are not intended to limit the scope of the invention in any way.

EXAMPLE 1

Two press cleaning aids were prepared according to the following formulations, the parts being parts by volume:

| CLEANER A | CLEANER B |
|---|---|
| 70 Parts Butyl Stearate<br>30 Parts d-limonene | 70 Parts iso cetyl Stearate<br>30 Parts d-limonene |

Both cleaners were very effective in removing ink from the rollers and blanket of an offset lithographic press.

A printing image was prepared on a Du Pont-Howson Super Spartan positive lithographic printing plate, and the printing image was exposed to daylight for 30 minutes. Part of the image was treated with Cleaner A, and part with Cleaner B. After 10 minutes the part of the image treated with Cleaner A had been severely attacked, and was unsuitable for printing. The part of the image treated with Cleaner B was unaffected, and printed many satisfactory copies.

EXAMPLE 2

Two lithographic plate cleaners were prepared using the following formulations:

| CLEANER C | CLEANER D |
|---|---|
| 100% by vol. Methyl Ester of Castor Oil Fatty Acids | 100% by vol. Ethyl Hexyl Ester of Coconut Oil Fatty acids |

The castor oil fatty acid mixture used had the following composition:

| | |
|---|---|
| Saturated and unsaturated $C_{11}$ and $C_{13}$ acids | 10 ± 2% by vol. |
| Saturated and unsaturated $C_{16}$ acids | 10 ± 2% by vol. |
| Saturated and unsaturated $C_{18}$ acids | 80 ± 2% by vol. |
| Hydroxy substituted $C_{18}$ acid (ricinoleic acid) | 2 ± 1% by vol. |

The coconut oil fatty acid mixture used had the following composition:

| | |
|---|---|
| $C_6$ acids | 0-1% by vol. |
| $C_8$ acids | 5-10% by vol. |
| $C_{10}$ acids | 5-10% by vol. |
| $C_{12}$ acids | 45-54% by vol. |
| $C_{14}$ acids | 15-21% by vol. |
| $C_{16}$ acids | 7-11% by vol. |
| $C_{18}$ acids (sat and unsat) | 10-12% by vol. |

A printing image was prepared on a Du Pont-Howson Marathon AQ3 negative lithographic printing plate. The plate was mounted on an offset lithographic press and used to print several thousand copies.

At this point, the press was stopped, and part of the printing image was cleaned with Cleaner C, and part of the printing image was cleaned with Cleaner D. The plate was then wiped over with a damp cloth and the press was re-started. The part of the image treated with Cleaner C soon began to show loss of fine detail and, after further running, it showed signs of premature image wear. The part of the image treated with Cleaner D gave no such problems.

EXAMPLE 3

A Heidelberg offset printing machine was cleaned in the manner described in the Example given in WO 90/03419 using stearic acid methyl ester and stearic acid 2-ethyl hexyl ester. In each case excellent cleaning of the inking rollers and the rubber blanket cylinder was achieved and the residues of both materials could easily be removed by wiping with a cloth, applying water with a sponge, and drying with a dry cloth.

The press was fitted with a Du Pont-Howson Super Amazon positive lithographic plate, which had been used to print several thousand copies. Each of the esters in turn was used to remove ink from areas of the image on the plate. Both esters gave rapid ink removal, but whilst the methyl ester gave a significant reduction in printing image colour, the area of image treated with the 2-ethyl hexyl ester was unaffected.

EXAMPLE 4

A cleaner E, suitable for cleaning damper rollers, was prepared according to the following formulation:

75% by vol Ethyl Hexyl Ester of Coconut Oil Fatty Acids

23% by vol Demineralised Water

2% by vol Alcohol Ethoxylate

After operation of the press with Hartmann Irolith Inks the damper sleeves were removed and soaked in the cleaner. The ink was rapidly removed by the cleaner and excellent cleaning of the damper sleeves resulted.

EXAMPLE 5

Cleaner F was formulated according to the disclosures in WO 90/03419 as follows:

88% by vol Methyl Ester of castor oil fatty acids

10% by vol Coconut oil

2% by vol Surfactant—lauryl alcohol ethoxylated with 5 ethoxy groups

70% by vol of this mixture was emulsified with 30% of a mixture of:

95% by vol Water

5% by vol lauryl alcohol ethoxylated with 9 ethoxy groups

Cleaner G was formulated by replacing the methyl ester of mixed fatty acids in Cleaner F with the ethyl hexyl ester of the mixed fatty acids.

Cleaner H was formulated by replacing both the ethoxylated lauryl alcohol surfactants in Cleaner G with equivalent amounts of a diethanolamide of oleic acid.

The three stable emulsion cleaners F, G and H all gave excellent cleaning of the rollers and blanket of a lithographic printing machine.

Small pools of each cleaner were then poured onto the image area of a Du Pont-Howson Triton positive lithographic printing plate and the time which elapsed before the first attack of the printing image occurred was noted in each case.

| | |
|---|---|
| Cleaner F | 30 seconds |
| Cleaner G | 4 minutes |
| Cleaner H | No attack after 10 minutes |

Cleaner G containing the ethyl hexyl ester had much less tendency to attack the image than Cleaner F containing the methyl ester. The benefit of using ethyl hexyl ester was improved even further by replacing the ethoxylated lauryl alcohol surfactant by oleic diethanolamide surfactant as indicated by Cleaner H.

EXAMPLE 6

Cleaner I was prepared as a stable emulsion by mixing a first phase of the formulation:

44 parts Ethyl Hexyl Ester of Coconut Oil Fatty Acids and 0.3 parts dedecyl alcohol ethoxylate and a second phase of the formulation:

44 parts Demineralised Water 2.5 parts carboxymethylcellulose (CMC 397)

5 parts Citric Acid (Hydrated)

3 5 parts Phosphoric Acid (90% w/w)

0.1 parts Parmetol A23 (a commercial biocide supplied by Sterling Chemicals and described as a synergistic mixture of halogenated acid amides and organic and inorganic activators)

0.6 parts Ethyl Hexyl Sulphate

A printing image was prepared on a Du Pont-Howson Marathon AQ3 negative lithographic printing plate and the plate mounted on an offset lithographic press and used to print four thousand copies. The press was stopped and the image was cleaned with the emulsion. The image cleaned well and, when the press was restarted, the plate was used to print several thousand further copies.

EXAMPLE 7

A cleaner J was prepared as a water miscible blanket wash according to the following formulation:

92% by vol Ethyl Hexyl Ester of Coconut Oil Fatty Acids

5% by vol d-Limonene 0.8% by vol Sorbitan monooleate 0.8% Polyoxyethylene sorbitan monooleate 1.4% Dioctylsulphosuccinate A Heidelberg sheet fed press was fitted with a Du Pont-Howson AQ3 negative lithographic printing plate and used to print several hundred copies, using a Rollin PCM blanket and Hartmann's Irolith Ink. The press was stopped, cleaner J applied to the blanket and wiped with a cloth, the blanket washed with a sponge and water and dried with a dry cloth. Excellent cleaning of the blanket was achieved by this method.

EXAMPLE 8

Example 7 was repeated with the Coconut Oil Fatty Acids replaced by an equivalent amount of decyl oleate oil (Crodamol DO). Similar results were obtained.

In view of the above it may be readily understood that the use of a composition containing $C_6$ or higher alkyl esters of fatty acids as the active agent provides a cleaning aid having excellent cleansing properties which may be used without injury to printing machinery, rollers, offset blankets or printing plates.

We claim:

1. A method of removing oil contaminants formed on surfaces of printing machines, printing plates and associated equipment which comprises the step of contacting the surface with a liquid cleaning aid comprising at least one $C_8$ or higher alkyl ester of a fatty acid in an amount of at least 30% by volume of the cleaning aid, said cleaning aid being characterized by exhibiting a substantially reduced tendency to degrade images on printing plates as compared to similar compositions containing similar amounts of $C_1$ to $C_5$ alkyl esters of fatty acids.

2. A method according to claim 1 wherein the fatty acid is saturated.

3. A method according to claim 1 wherein the fatty acid is unsaturated.

4. A method according to claim 1, wherein the fatty acid contains from 8 to 22 carbon atoms.

5. A method according to claim 1 wherein the fatty acid ester comprises a mixture of fatty acid esters.

6. A method according to claim 5 wherein the fatty acid ester comprises the 2-ethyl hexyl esters of mixed fatty acids derived from coconut oil.

7. A method according to claim 1 wherein the fatty acid ester is a major component of the cleaning aid which contains other complimentary components, said components being selected from one or more of surfactants, emulsifiers, vegetable oils, $C_1$ to $C_5$ alkyl esters of fatty acids, water, organic solvents, acids, bases, alkalis, buffer systems, sequestrant and corrosion inhibitors.

8. A method according to claim 1 wherein the cleaning aid further comprises a surfactant in an amount of up to 20% by volume and/or an organic solvent in an amount of up to 30% by volume, the cleaning aid optionally including up to 10% by volume of a vegetable oil, up to 10% by volume of a $C_1$ to $C_5$ alkyl ester of a fatty acid, and up to 60% by volume of water.

* * * * *

UNITED STATES PATENT AND TRADEMARK OFFICE

CERTIFICATE OF CORRECTION

PATENT NO. : 5,194,173

DATED : March 16, 1993

INVENTOR(S) : Christopher W. Folkard and Gary A.J. Goddard

It is certified that error appears in the above-identified patent and that said Letters Patent is hereby corrected as shown below: Column 6, lines 4-5:

In the claims, please delete "at least one $C_8$ or higher alkyl ester of a fatty acid" and substitute therefor - - at least one $C_6$ or higher alkyl ester of a fatty acid - -.

Signed and Sealed this

Fifth Day of July, 1994

*Attest:*

Bruce Lehman

BRUCE LEHMAN

*Attesting Officer*

*Commissioner of Patents and Trademarks*